United States Patent [19]

Bilbrey

[11] 4,294,364

[45] Oct. 13, 1981

[54] LOG CRADLE

[76] Inventor: Donald L. Bilbrey, 3481 Mills Acres, Flint, Mich. 48503

[21] Appl. No.: 12,642

[22] Filed: Feb. 16, 1979

[51] Int. Cl.[3] ..... A47F 7/00

[52] U.S. Cl. ..... 211/60 R

[58] Field of Search ..... 211/60 R, 13; 34/237, 34/239; 312/212, 229; 108/25; 110/166, 168

[56] References Cited

U.S. PATENT DOCUMENTS

| | | | |
|---|---|---|---|
| 2,584,219 | 2/1952 | Murrell | 312/229 X |
| 2,660,313 | 11/1953 | James | 312/229 X |
| 3,185,537 | 5/1965 | Wright | 211/13 X |
| 3,187,901 | 6/1965 | Wilson | 211/60 R |
| 3,216,585 | 11/1965 | Whittle | 211/60 R |
| 3,278,042 | 10/1966 | Frydenberg | 211/60 R |

*Primary Examiner*—Roy D. Frazier
*Assistant Examiner*—Robert W. Gibson, Jr.
*Attorney, Agent, or Firm*—Basile, Weintraub & Hanlon

[57] ABSTRACT

A storage device for storing logs or similar combustible materials includes a base and materials receiving portion having a bottom and sides which permit ventilation of the stored material. A removable receptacle for catching debris falling from the supported materials is slidingly insertable within the base to facilitate the disposal of the debris.

6 Claims, 2 Drawing Figures

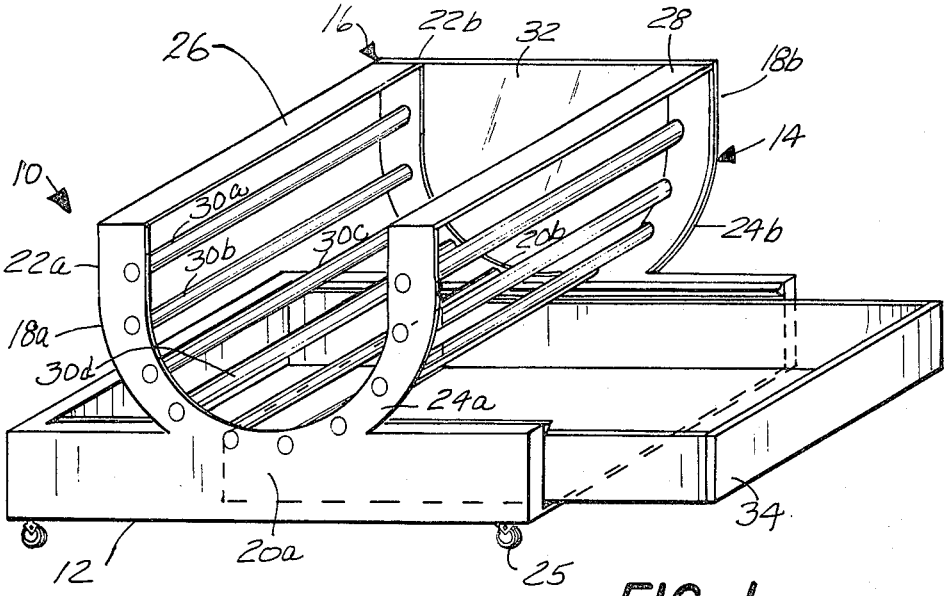
FIG-1
FIG-2
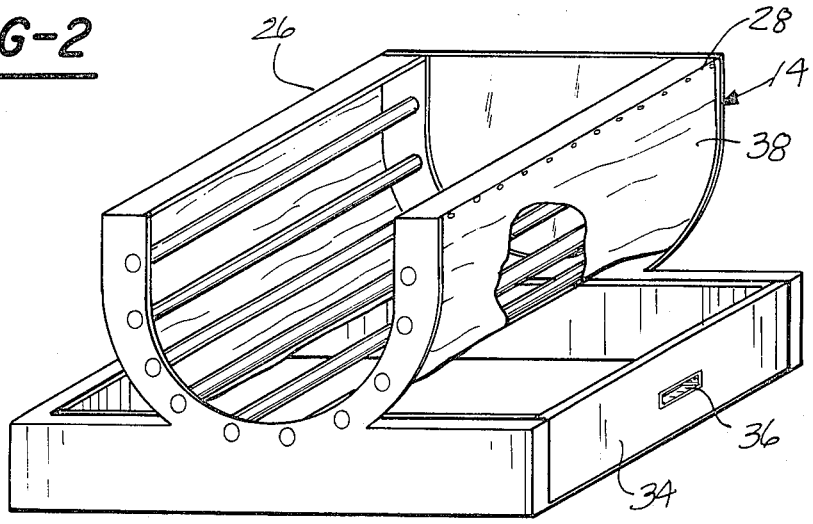

LOG CRADLE

BACKGROUND OF THE INVENTION

I. Field of the Invention

The present invention pertains to storage devices. More particularly, the present invention pertains to storage devices provided with removable waste disposal means. Even more particularly, the present invention pertains to storage devices, provided with removable waste disposal means for storing logs or similar combustible materials.

II. Prior Art

The storage of such materials as logs for kindling in fireplaces presents certain requirements which are well known in the art. Namely, it is required that the logs be kept dry to maximize their effectiveness in the fireplace. To this purpose, numerous lumber racks provided in the prior art comprise open sided devices comprising straps, logs or bars or the like which support the logs off the ground surface, thereby permitting maximum exposure thereof to the air.

However, the storage of timber materials such as logs ordinarily results in an accumulation of certain wood debris, such as pieces of bark, scraps of wood, saw dust and the like. While open sides and bottoms are desirable to maintain the proper condition of the wood, they also permit the wood debris and dust to fall to the floor thereby requiring constant maintenance and cleaning.

Therefore, substantial advantages would be achieved by providing a wood cradle having an exposed bottom and sides with a receptacle for collecting wood shavings and debris. Further advantages would be achieved by providing a receptacle for wood debris which may be removed from the storage device for easy emptying and cleaning thereof.

PRIOR ART STATEMENT

In the opinion of the applicant, U.S. Pat. Nos. 297,485, 732,037, 3,187,901 and 3,278,042 comprise the most relevant prior art of which the applicant is aware.

SUMMARY OF THE INVENTION

The present invention which will be described subsequently in greater detail comprises a storage device particularly adapted for the indoor storing of fireplace timber.

The storage device comprises a base and a material receiving portion having air exposed bottom and sides mounted thereon. The storage device is provided with a removable debris receptacle which is adapted to fit snugly within the base, beneath the cradle.

In a preferred embodiment, the cradle comprises a frame having two opposed members mounted thereon through which a plurality of parallel bars are supported, which bars comprise the sides and bottom of the cradle. The base of the preferred embodiment comprises a partially walled, open topped structure which is adapted to receive, slidingly, a debris receptacle which is dimensioned to nest snugly therewithin.

It is therefore a primary object of the present invention to provide an exposed storage device for fireplace timber which is equipped with a removable receptacle for debris falling from the timber.

It is a further object of the present invention to provide a storage device for fireplace timber which is aesthetically pleasing and which provides means by which debris falling from the timber can be contained and disposed of easily.

Other objects, advantages and applications of the present invention will become apparent to those skilled in the art when the accompanying description of the present invention is read in conjunction with the accompanying drawing.

BRIEF DESCRIPTION OF THE DRAWING

The description herein makes reference to the accompanying drawings wherein like reference numerals refer to like parts throughout the several views in which:

FIG. 1 is a front perspective view of the wood storage device hereof;

FIG. 2 is a front perspective view of a second embodiment of the wood storage device hereof.

DESCRIPTION OF THE PREFERRED EMBODIMENT

Referring now to the drawings and in particular to FIG. 1, there is illustrated generally at 10 a device for storing combustible materials, such as logs, commonly used in fireplaces. The device may be constructed from wood or plastic or any suitably durable material. The device 10 comprises a base portion indicated at 12 and a cradle or receiving means 14, which is adapted to receive and store logs.

In order to maintain the lumber in a properly dry condition, the logs are supported above the ground. The device hereof, also, provides adequate ventilation thereto. Accordingly, the receiving means 14 hereof is preferably mounted at the top of the base 12 and is provided with sides and bottom which permit ventilation of the stored material.

In a preferred embodiment, the receiving means 14 is defined by a frame 16. A plurality of support elements are supported by the frame 16. In the preferred embodiment, the frame 16 comprises two opposed front and rear frame members, 18*a*, 18*b*, respectively. Each member has a bottom portion 20*a* or 20*b* which is generally horizontal and two side portions 22*a*, 22*b* and 24*a*, 24*b*, respectively, which are generally vertical. The opposing frame members may be connected by upper wall members, 26, 28 which extend between the opposed side portions of the frame members at their upper extremes as shown.

In the preferred embodiment, the support elements which cooperate with the frame 16 to define the receiving means 14 comprise a plurality of parallel bars designated at 30*a*, 30*b*, 30*c*, etc. which extend between the opposed frame support members 18*a*, 18*b*. However, any other support means suitable for supporting kindling wood, such as straps or the like, may be used if desired and such elements may be supported between the opposing frame members 18*a*, 18*b*, as shown, or from the upper wall members, 26, 28.

It is to be appreciated that the opposed frame support members may comprise any suitable configuration such as open rectangular or V-shapes. However, excellent and aesthetically pleasing results are achieved using U-shaped support members. The series of parallel rods 30*a*, 30*b*, 30*c*, etc. extending between the U-shaped support members, 18*a*, 18*b*, thus define a substantially U-shaped cradle, having an exposed bottom and sides.

The rods 30*a*, 30*b*, etc. may be supported from the support elements 18*a*, 18*b* by any convenient means. In the preferred embodiment, the opposed support elements are provided with a series of spaced, opposing apertures which are adapted to receive matingly and snugly the ends of the rods extending between the frame support members 18*a*, 18*b*. If desired, rods 30*a*, 30*b*, etc. may be secured permanently into place within the apertures by adhesive means. However, it is to be appreciated that the manner in which the rods are supported between the frame members 18*a*, 18*b* is not critical and any suitable mounting means may be employed.

As illustrated in the drawings the preferred embodiment further comprises a back wall 32 which traverses the rear support element 18*b* defining a closed wall therewith. This wall 32 provides protective means to prevent logs from falling out the rear of the cradle.

The base 12, as shown in the drawings, comprises an open topped, structure having at least two walls and at least one open portion to permit a debris receptacle 34 to be emplaced therein in a manner which will be described hereinbelow. Although the base is depicted in the drawings as substantially rectangular, alternate configurations may be employed. However, it is desirable that the area defined by the base exceed that defined by the cradle to ensure that all logs resting within the cradle are disposed over the base.

The base 12 is adapted to receive, slidingly, a debris receptacle 34 which is provided to catch and contain debris falling from the stored materials in the cradle. The debris receptacle 34 is adapted to slide into and is dimensioned to nest snugly within the base 12. In the preferred embodiment, the receptacle 34 comprises an open topped rectangular container having a height substantially equal to the height of the base 12. In this manner, the receptacle 34 may be slidingly inserted into the base, beneath the receiving means 14. It is further to be noted that although the receptacle 34 may be shorter than the base, or even be defined by a flat tray, it is preferred that the height of the receptacle be equal to that of the base such that the upper surfaces of the receptacle and the base are co-extensive, thereby minimizing the opportunity for debris to fall directly into the base from the receiving means 14 or from the receptacle 34, itself, when the receptacle 34 is removed for cleaning. Alternatively, debris falling from the materials may be channeled into the receptacle 34 by providing the base walls with ledges, inclined downwardly toward the receptacle, as shown in FIG. 1.

Further convenience may be achieved by providing the base with a plurality of casters 25 to permit the device to be moved as desired even when filled.

If desired, the receptacle 34 may be further provided with opening means 36 as shown in FIG. 2. These opening means 36 may comprise any manner of knob or hardware chosen to achieve a desired aesthetic effect.

Now and with further reference to FIG. 2, there is depicted therein a second embodiment of the present invention wherein the wood receiving means 14 is provided with a cover, 38. The cover 38 may comprise any durable, flexible material. This second embodiment of the invention is particularly adapted to store such kindling materials as charcoal which are generally too small to be supported by the exposed storage device illustrated in FIG. 1. Thus, when it is desired to store such small, combustible materials, the cover 38 may be attached thereto and supported from the frame. This may be achieved by mounting the cover 38 to the upper wall members 26, 28 by hooks, nails, or any suitable fastening means. The cover may be used along with the support elements or alone to receive and contain the kindling material.

Adequate ventilation of the charcoal or other combustible materials contained within the second embodiment of the storage device may be provided by selecting a porous, loosely woven or mesh material for the cover 38. The use of a material which permits a substantial amount of ventilation may be applied herein and any dust, dirt or other debris escaping from the materials through the cover 38 will be collected in receptacle 34 for disposal.

It is to be appreciated from the preceding that there has been described herein a storage device for storing logs or other combustible materials for use in fireplaces which provides for adequate ventilation of the stored materials, which is aesthetically pleasing, and which provides for easy maintenance and disposal of waste materials falling therefrom. It is also to be appreciated that the storage device hereof is amenable to a variety of adaptations in style and construction, all falling within the scope and spirit of the present invention.

Having thus described the invention, what is claimed is:

1. A storage device for storing kindling materials comprising:

a base;

means for receiving kindling materials mounted on the base and having a bottom and sides provided with air access means, the means for receiving kindling material defined by a frame, the frame comprising at least two opposed frame members mounted to the base and a plurality of material supporting elements extending between and supported from the frame members; and a debris receiving receptacle adapted to be slidingly and removably inserted into and nest snugly within the base, beneath the receiving means.

2. The storage device of claim 1 wherein:

the base comprises a partially enclosed open top structure and wherein the area defined by the base exceeds the area defined by the receiving means.

3. The storage device of claim 1 wherein:

the debris receiving receptacle comprises an open topped container having a height substantially equal to the height of the base.

4. The storage device of claim 1 which further comprises:

two upper wall members extending between the opposed support members at the upper extremes thereof.

5. A storage device for storing kindling materials comprising:

a base;

means for receiving kindling materials mounted on the base and having a bottom and sides provided with air access means, the material receiving means defined by a frame comprising at least two opposed support members mounted to the base, upper wall members extending between the opposed support members at the upper extremes thereof and support means supported from the upper wall members; and a debris receiving receptacle adapted to be slidingly and removably inserted into and nest snugly within the base, beneath the receiving means.

6. The storage device of claim 1 wherein said support means are defined by a cover fabricated from a porous material.

* * * * *